US009429286B2

(12) United States Patent
Luo et al.

(10) Patent No.: US 9,429,286 B2
(45) Date of Patent: Aug. 30, 2016

(54) COMBINATION CEILING FAN AND LAMP

(71) Applicants: Wen-Hong Luo, Taichung (TW); Jhong-Ruei He, Taichung (TW)

(72) Inventors: Wen-Hong Luo, Taichung (TW); Jhong-Ruei He, Taichung (TW)

(73) Assignee: Ching-Wen Liu, Taichung (TW)

( * ) Notice: Subject to any disclaimer, the term of this patent is extended or adjusted under 35 U.S.C. 154(b) by 0 days.

(21) Appl. No.: 14/746,867

(22) Filed: Jun. 23, 2015

(65) Prior Publication Data

US 2015/0285451 A1 Oct. 8, 2015

(51) Int. Cl.

| | |
|---|---|
| ***F21V 21/00*** | (2006.01) |
| ***F21S 8/06*** | (2006.01) |
| ***F21V 33/00*** | (2006.01) |
| ***F21V 1/00*** | (2006.01) |
| ***F21V 21/112*** | (2006.01) |
| *F21V 21/02* | (2006.01) |
| *F21W 121/00* | (2006.01) |

(52) U.S. Cl.

CPC ..... *F21S 8/061* (2013.01); *F21V 1/00* (2013.01); *F21V 21/112* (2013.01); *F21V 33/0096* (2013.01); *F21V 21/02* (2013.01); *F21W 2121/00* (2013.01)

(58) Field of Classification Search

CPC .... F04D 25/088; F21S 8/61; F21V 33/0096; F21V 21/008

USPC ..... 362/96, 382, 391, 404, 405, 407

See application file for complete search history.

(56) References Cited

U.S. PATENT DOCUMENTS 6,397,869 B1 * 6/2002 Jennings ..... E04H 15/14 135/120.1

* cited by examiner

*Primary Examiner* — Vip Patel

(57) ABSTRACT

A ceiling fan includes a plurality of steel ropes; an attachment device secured to first ends of the steel ropes; and a fan and light assembly secured to second ends of the steel ropes. The steel rope has two enlargements at respective ends thereof. The enlargements are moveably disposed in the attachment device and the fan and light assembly so that both installation and detachment are made easy.

14 Claims, 6 Drawing Sheets

COMBINATION CEILING FAN AND LAMP

BACKGROUND OF THE INVENTION

1. Field of the Invention

The invention relates to ceiling fans and more particularly to a combination ceiling fan and a lamp with improved characteristics.

2. Description of Related Art

There is a type of ceiling fan equipped with a light so that the purposes of ventilation and illumination can be achieved. It includes a light disposed under fan blades. However, the conventional ceiling fan with light has the following drawbacks:

First, the light may interfere with the airflow, thereby decreasing cooling efficiency.

Second, the airflow is directed downward and thus its cooling range is limited.

Third, light emitted by the light is directed downward and thus other spaces may be illuminated insufficiently.

Fourth, a steel pipe containing electric wire is attached to the ceiling. It is inconvenient of cleaning or repair because an individual has to use a ladder to clear or repair the ceiling fan. Further, it may cause danger. Furthermore, the ceiling fan is not allowed to dangle greatly due to the nature of the steel pipe. In addition, the steel pipe may be bent due to earthquake. The bent steel pipe can compromise equilibrium of the ceiling fan.

Thus, the need for improvement still exists.

SUMMARY OF THE INVENTION

It is therefore one object of the invention to provide a light fixture comprising a plurality of steel ropes; an attachment device secured to first ends of the steel ropes; and a fan and light assembly secured to second ends of the steel ropes.

The above and other objects, features and advantages of the invention will become apparent from the following detailed description taken with the accompanying drawings.

DETAILED DESCRIPTION OF THE INVENTION

Figure 1:
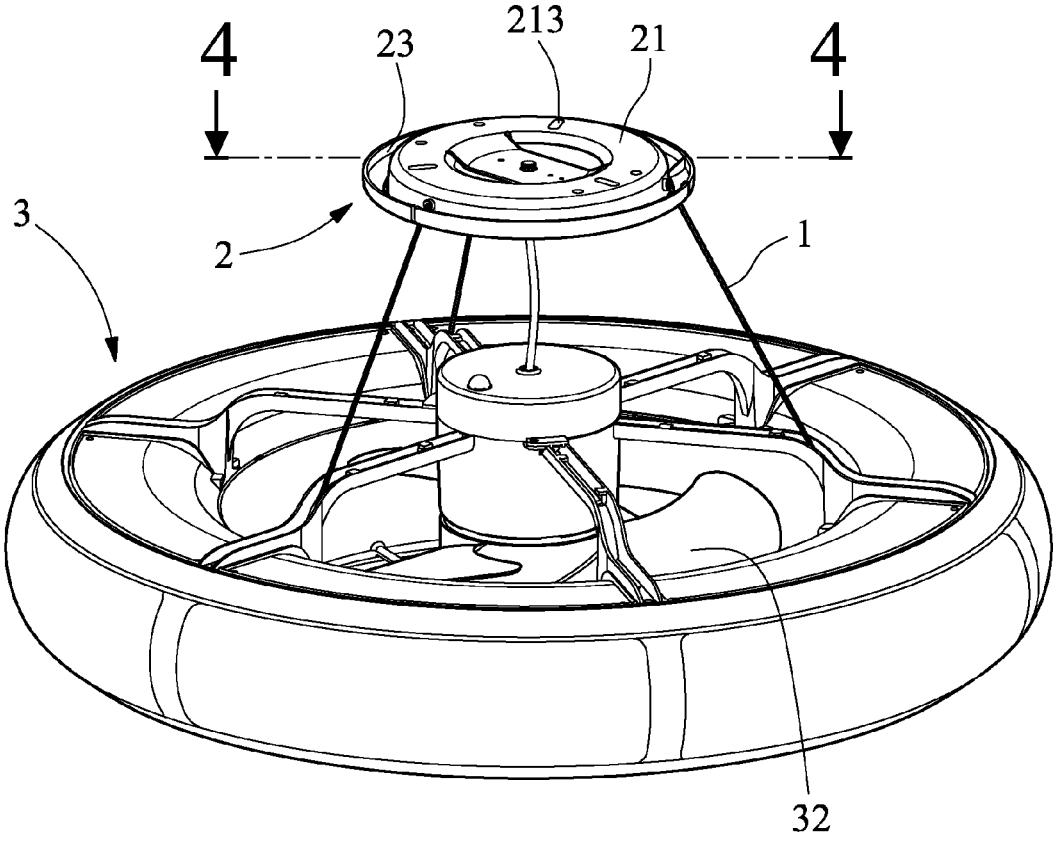
FIG. 1 is a perspective view of a ceiling fan according to the invention.
Figure 2A:
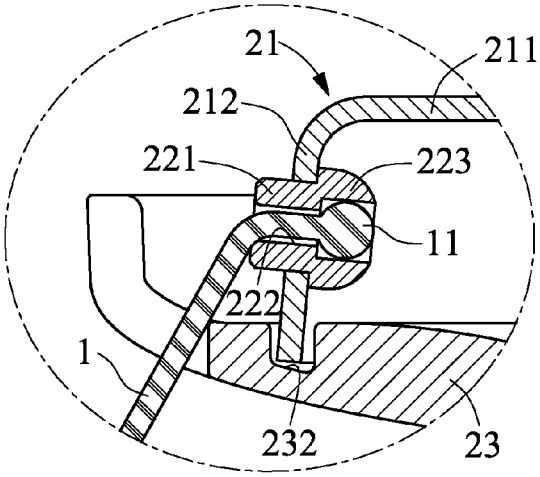
FIG. 2A is a detailed view of the area in circle A in FIG. 2.
Figure 2:
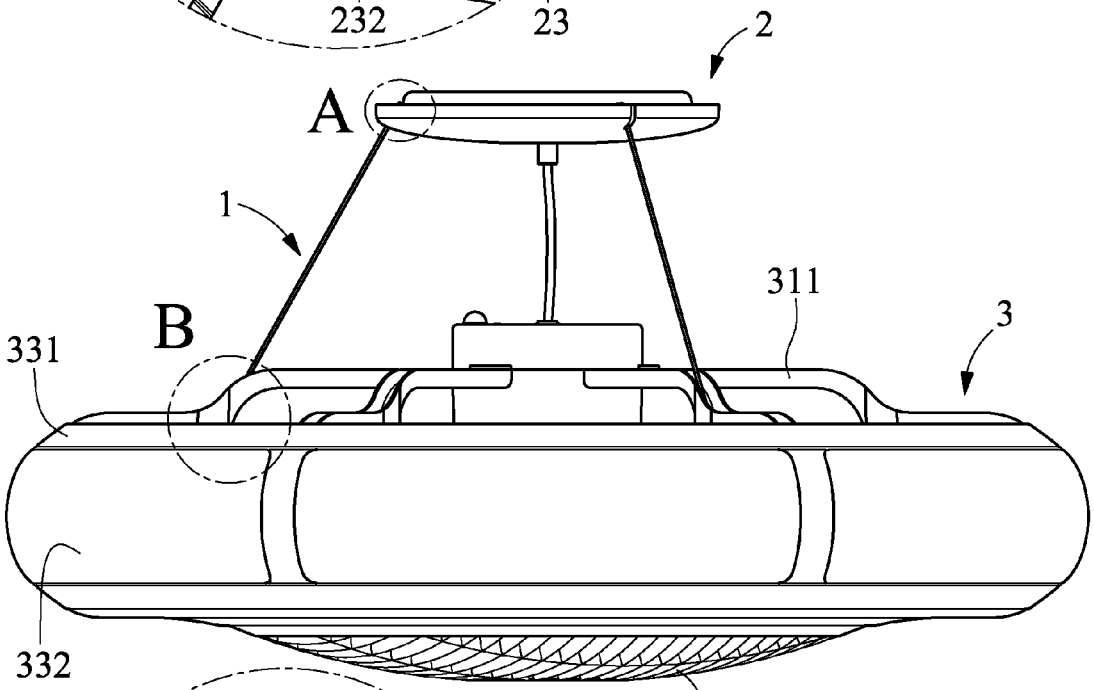
FIG. 2 is a side elevation of the ceiling fan.
Figure 2B:
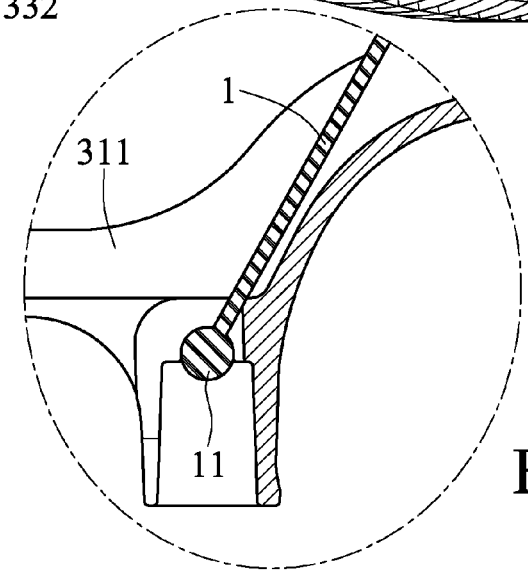
FIG. 2B is a detailed view of the area in circle B in FIG. 2.
Figure 3:
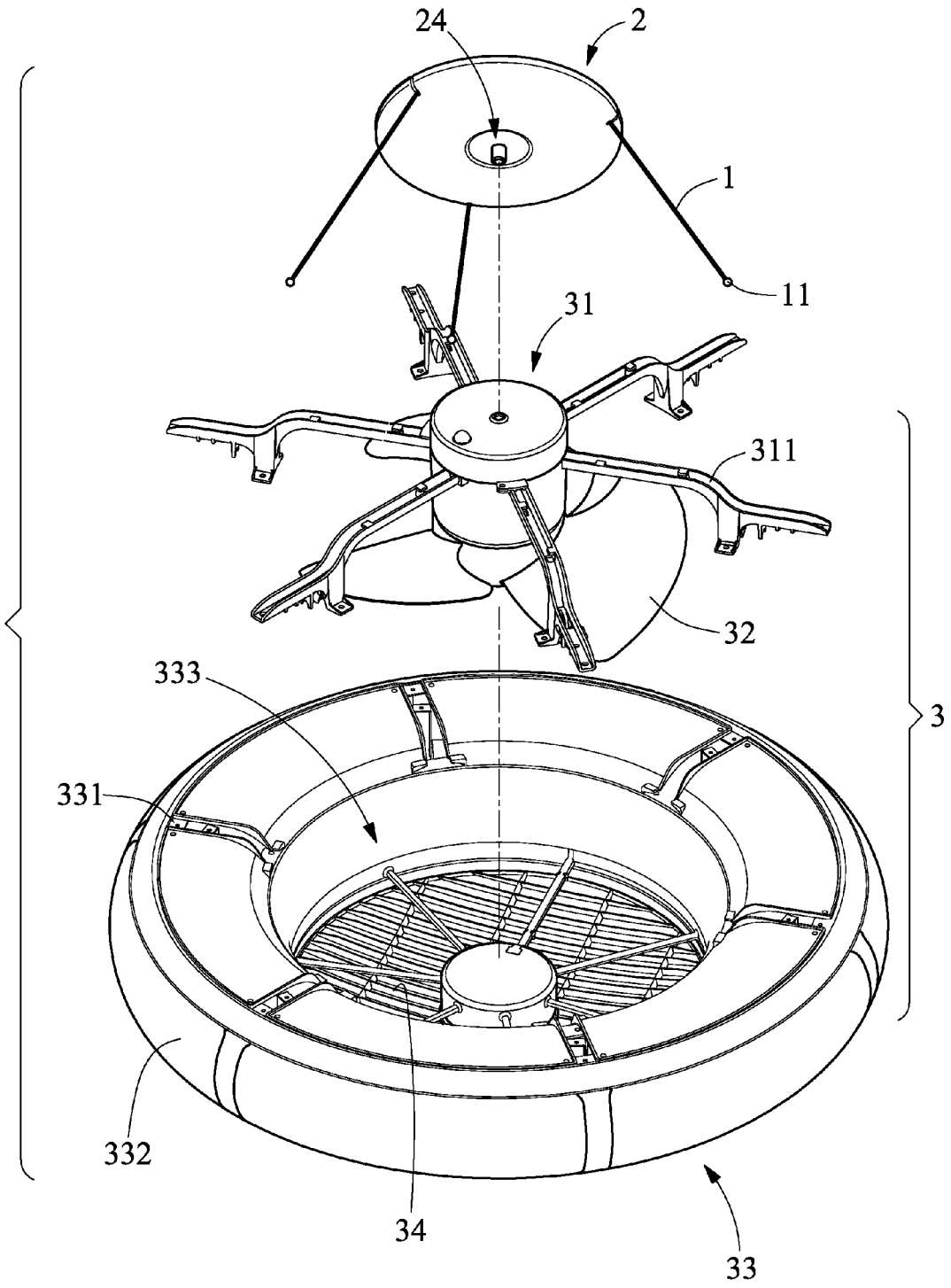
FIG. 3 is an exploded view of the ceiling fan.
Figure 4:
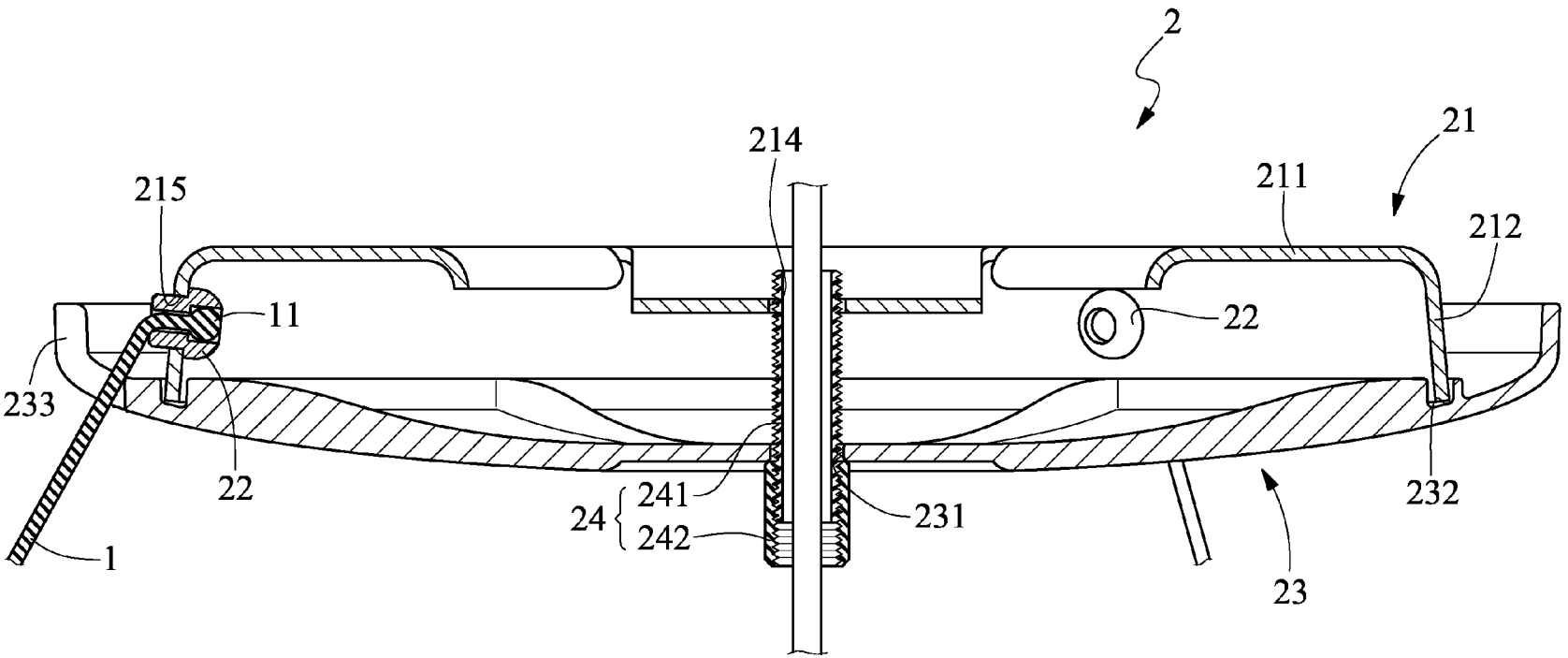
FIG. 4 is a sectional view taken along line 4-4 of FIG. 1.

Referring to FIGS. 1 to 7, a ceiling fan in accordance with the invention comprises a plurality of steel ropes 1, an attachment device 2 attached to one ends of the steel ropes 1, and a fan and light assembly 3 attached to the other ends of the steel ropes 1 as discussed in detail below.

The steel rope 1 includes an enlargement 11 in either end. The enlargement 11 can be a sphere, a cone, or the like.

The attachment device 2 includes an attachment 21 on a top, a plurality of hollow anchor members 22 through an annular vertical part 212 of the attachment 21, a decoration member 23 on a bottom, and a fastening assembly 24 for fastening the attachment 21 and the decoration member 23 together.

The attachment 21 includes a ring shaped horizontal part 211 and the annular vertical part 212 depending downward from the horizontal part 211. A plurality of thread holes 213 are formed through the horizontal part 211 and a central threaded hole 214 is formed through a center of the horizontal part 211. A plurality of holes 215 are formed through the vertical part 212.

The anchor members 22 are fastened at the holes 215. In detail, the anchor member 22 includes a narrow part 221, an enlarged part 223, and a stepped-diameter passageway 222 through the narrow part 221 and the enlarged part 223. The anchor member 22 is flexible and fastened at the hole 215 by urging a joining portion of the narrow part 221 and the enlarged part 223 against an edge of the hole 215. The steel rope 1 passes through the passageway 222 to have its enlargement 11 moveably positioned in the enlarged part 223. A plurality of threaded fasteners (not shown) are driven through the thread holes 213 into a ceiling (not shown) to fasten the attachment device 2 (i.e., the ceiling fan) and the ceiling together.

The decoration member 23 is slightly larger than the attachment 21 and has an open top. The decoration member 23 is disc shaped and includes a thread hole 231 through a center, an annular groove 232, and a plurality of slits 233 through a raised edge. The thread hole 231 is aligned with the threaded hole 214. The bottom of the vertical part 212 is complimentarily disposed in the groove 232. The slits 233 correspond to the holes 215 respectively. Further, the steel ropes 1 pass through the slits 233 prior to positioning at the hollow members 22. Alternatively, the decoration member 23 is eliminated in other embodiments.

The fastening assembly 24 includes an externally threaded pipe 241 disposed through the threaded hole 214 and the thread hole 231, and an internally threaded sleeve 241 threadedly secured to a lower portion of the externally threaded pipe 241 and urging against an underside of the decoration member 23. As a result, the attachment 21 and the decoration member 23 are secured together.

The fan and light assembly 3 includes a support 31, a fan 32, a light 33, and a louver 34. In detail, the support 31 includes a plurality of radially extending spreaders 311 each at its bent portion having a first cavity 312 and a second cavity 313 communicating with the first cavity 312. Size of the first cavity 312 is greater than that of the enlargement 11 so that the enlargement 11 can be moveably disposed in the first cavity 312. A well 314 is formed on an inner end of the second cavity 313 and shaped to complimentarily receive a portion of the enlargement 11.

The fan 32 is provided on a center of the fan and light assembly 3 and electrically connected to the household power (not shown) by an electric wire (not shown) passing through the fastening assembly 24. The light 33 includes a plurality of fastening members 331 secured to the spreaders 311, and an annular light shade 332 secured to the fastening members 331. The fan 32 is disposed in a space 333 defined by the light shade 332. Illumination unit (e.g., fluorescent lamp, light bulb, or LEDs (light-emitting diodes) (not shown) is disposed in the light shade 332. The light 33 and the fan 32 are electrically connected together. Alternatively, the light 33 is electrically connected to the household power by an electric wire passing through the fastening assembly 24. The louver 34 is directly under the fan 32 and secured to the fastening members 331. The lower portion of the space 333 is separated from the outside space by the louver 34. Airflow created by the fan 32 is directed out of the ceiling fan to a greater space in a house via the louver 34.

Figure 5:
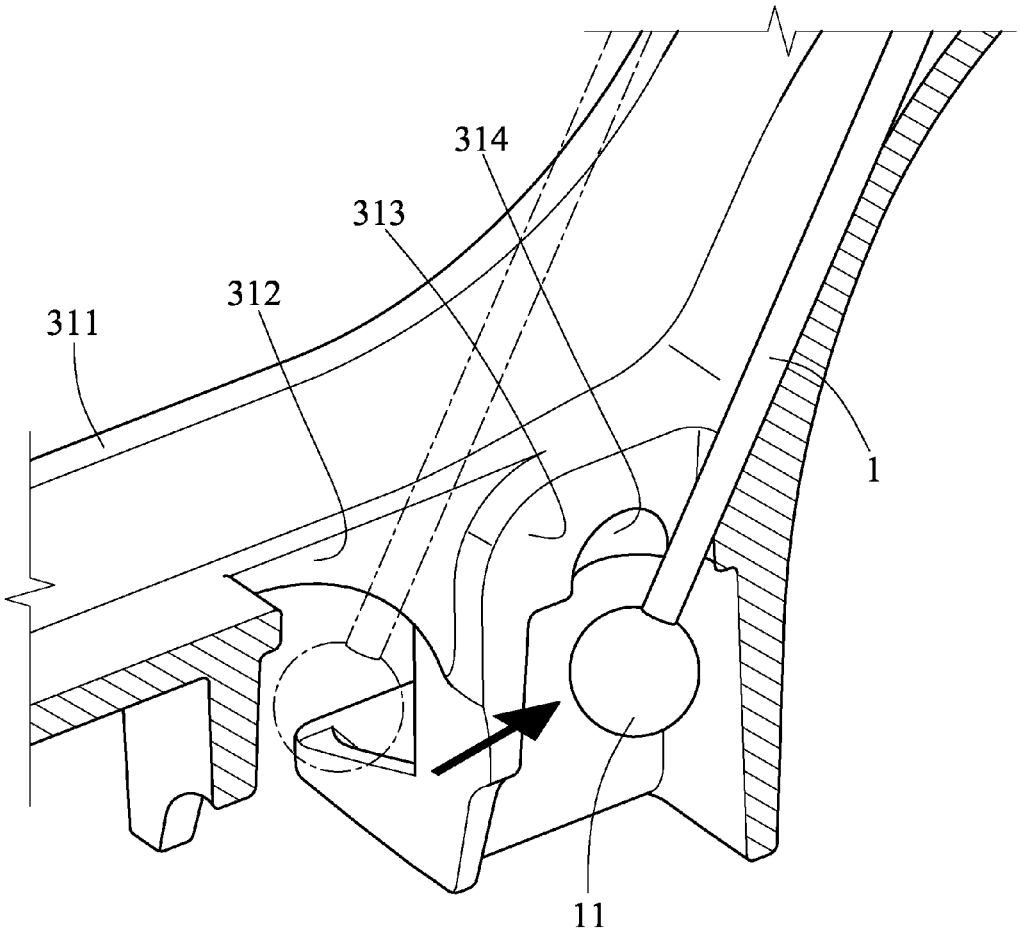
FIG. 5 is an enlarged view of FIG. 2B showing movement of the enlargement.
Figure 6:
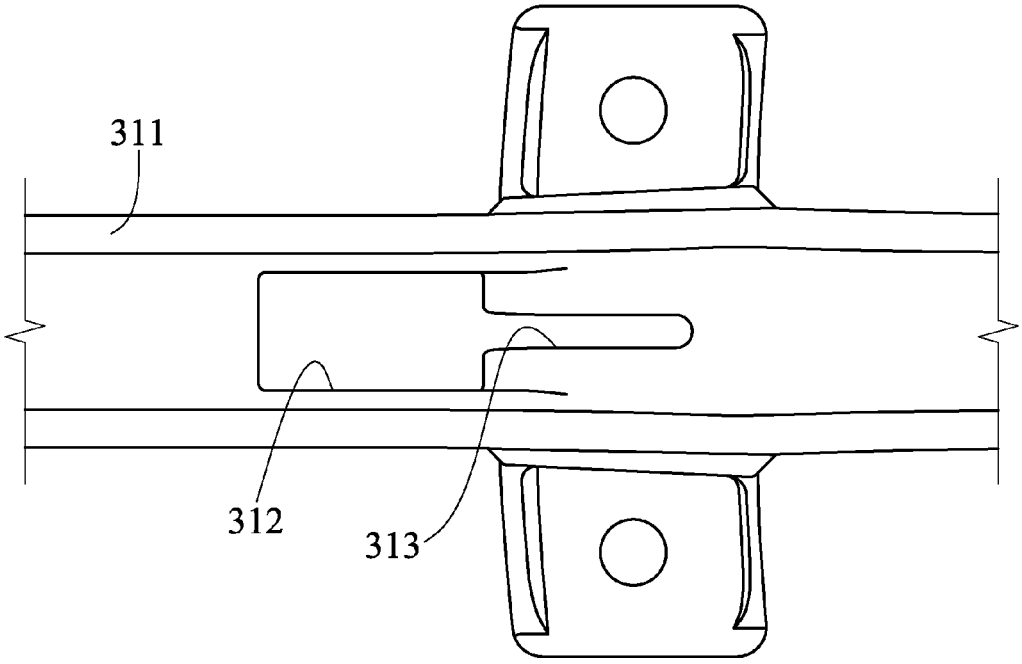
FIG. 6 is an enlarged top view of a portion of the spreader.
Figure 7:
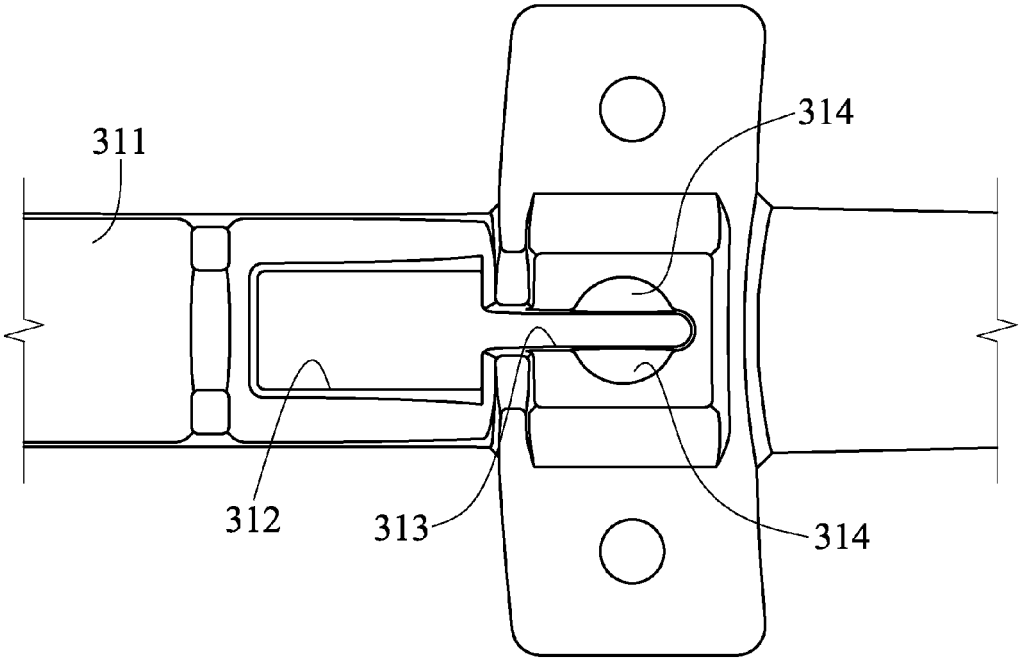
FIG. 7 is an enlarged bottom view of the portion of the spreader shown in FIG. 6.

Assembly, operation, and advantages of the invention are discussed below. First, a plurality of threaded fasteners are used to secure the attachment 21 to the ceiling. Next, one end of the steel rope 1 is moveably positioned in the anchor member 22 which is fastened at the hole 215 of the attachment 21. The steel rope 1 passes through the slit 233 to have its other end moveably positioned in the fan and light assembly 3. In detail, as shown in FIGS. 5 to 7, the steel rope 1 passes through the first cavity 312 so that the enlargement 11 at one end of the steel rope 1 is adapted to moveably position in the first cavity 312. Further, the enlargement 11 moves from the first cavity 312 to the second cavity 313 to anchor in the well 314. Thus, the steel rope 11 has one end moveably disposed in the spreader 31. The fan and light assembly 3 is thus disposed under the attachment device 2 due to its own weight.

For repairing or cleaning the ceiling fan, an individual may detach the electric wire. Next, the individual may move the enlargement 11 from the second cavity 313 to the first cavity 312. Thus, the enlargement 11 is free to disengage the fan and light assembly 3 from the attachment device 2. Finally, the individual may begin his or her work. It can greatly decrease the danger of working in an elevated position and thus facilitates the work.

While the invention has been described in terms of preferred embodiments, those skilled in the art will recognize that the invention can be practiced with modifications within the spirit and scope of the appended claims.

What is claimed is:

1. A light fixture comprising:

a plurality of steel ropes;

an attachment device secured to first ends of the steel ropes; and a fan and light assembly secured to second ends of the steel ropes.

2. The light fixture of claim 1, wherein the steel ropes includes two limit members at the respective first and second ends thereof.

3. The light fixture of claim 2, wherein each limit member is a member having a predetermined shape.

4. The light fixture of claim 3, wherein the attachment device includes an attachment on a top, the attachment having a horizontal part, a vertical part depending downward from the horizontal part, and a plurality of holes formed through the vertical part for anchoring the first ends of the steel ropes.

5. The light fixture of claim 4, further comprising a plurality of hollow anchor members through the vertical part of the attachment, each anchor member being fastened at the hole with the steel rope passing through.

6. The light fixture of claim 5, wherein each of the anchor members includes a narrow part, an enlarged part, and a stepped-diameter passageway through both the narrow part and the enlarged part.

7. The light fixture of claim 6, wherein the fan and light assembly includes a support, a fan, and a light, wherein the support includes a plurality of radially extending spreaders, each spreader having a first cavity and a second cavity communicating with the first cavity, and wherein size of the first cavity is greater than that of the limit member, and size of the second cavity is greater than a diameter of the steel rope.

8. The light fixture of claim 7, wherein the light includes a plurality of fastening members secured to the spreaders, an annular light shade secured to the fastening members, and a space defined by the light shade for accommodating the fan.

9. The light fixture of claim 8, wherein the fan and light assembly further comprises a louver disposed directly under the fan and secured to the fastening members, a lower portion of the space being blocked by the louver.

10. The light fixture of claim 9, wherein the attachment device further comprises a decoration member secured to a bottom of the attachment.

11. The light fixture of claim 10, wherein the decoration member includes a plurality of slits through an edge for passing through the steel ropes.

12. The light fixture of claim 11, wherein the horizontal part includes at least one threaded hole, and wherein the decoration member further includes a thread hole aligned with one of the at least one threaded hole.

13. The light fixture of claim 12, wherein the attachment device further includes a fastening assembly having an externally threaded pipe disposed through one of the at least one threaded hole, and an internally threaded sleeve threadedly secured to a lower portion of the externally threaded pipe and urging against an underside of the decoration member so that the attachment and the decoration member are secured together.

14. The light fixture of claim 13, wherein the decoration member further includes a groove for accommodating a bottom of the vertical part.

* * * * *